US008791786B2

(12) United States Patent
Maeda et al.

(10) Patent No.: US 8,791,786 B2
(45) Date of Patent: Jul. 29, 2014

(54) COIL DEVICE

(71) Applicants: TDK Corporation, Tokyo (JP); TDK Korea Corporation, Seoul (KR)

(72) Inventors: Hiroshi Maeda, Tokyo (JP); Terumasa Toyoda, Tokyo (JP); Kiho Hwang, Seoul (KR); Sukho Shin, Seoul (KR)

(73) Assignees: TDK Corporation, Tokyo (JP); TDK Korea Corporation, Seoul (KR)

( * ) Notice: Subject to any disclaimer, the term of this patent is extended or adjusted under 35 U.S.C. 154(b) by 0 days.

(21) Appl. No.: 13/645,311

(22) Filed: Oct. 4, 2012

(65) Prior Publication Data

US 2013/0154787 A1 Jun. 20, 2013

(30) Foreign Application Priority Data

Oct. 5, 2011 (JP) ..... 2011-221292

(51) Int. Cl.

| | |
|---|---|
| ***H01F 27/28*** | (2006.01) |
| ***H01F 21/06*** | (2006.01) |
| ***H01F 27/30*** | (2006.01) |
| ***H01F 27/24*** | (2006.01) |
| ***H01F 27/34*** | (2006.01) |
| ***H01F 27/32*** | (2006.01) |
| ***H01F 5/00*** | (2006.01) |

(52) U.S. Cl.

CPC ..... *H01F 5/00* (2013.01); *H01F 27/346* (2013.01); *H01F 27/326* (2013.01)

USPC ..... 336/220; 336/136; 336/182; 336/198; 336/212; 336/222

(58) Field of Classification Search

USPC ..... 336/136, 182, 192, 198, 212, 222

See application file for complete search history.

(56) References Cited

U.S. PATENT DOCUMENTS 6,344,786 B1 * 2/2002 Chin ..... 336/198

FOREIGN PATENT DOCUMENTS

| | | |
|---|---|---|
| JP | 2005-158927 | 6/2005 |
| JP | 2006-108390 | 4/2006 |

* cited by examiner

*Primary Examiner* — Elvin G Enad
*Assistant Examiner* — Ronald Hinson
(74) *Attorney, Agent, or Firm* — Muncy, Geissler, Olds & Lowe, P.C.

(57) ABSTRACT

A coil device 10 comprises a first bobbin 40 having a first bobbin plate 42 provided with a first hollow cylinder 44 on which a primary coil 20 is wound at the outer periphery, and a second bobbin 50 mounted on the first bobbin 40 and having a second bobbin plate 52 provided with a second hollow cylinder 54 on which a secondary coil 30 is wound at the outer periphery. A winding center C1 of the primary coil 20 and a winding center C2 of the secondary coil 30 displace with a predetermined displacement (Lx) along a predetermined reference direction X.

9 Claims, 12 Drawing Sheets

COIL DEVICE

BACKGROUND OF THE INVENTION

1. Field of the Invention

The present invention relates to a coil device preferably used for a resonance transformer and the like.

2. Description of the Related Art

Coil devices are used in various electrical products for various uses. For instance, in a lighting circuit for a backlight of liquid crystal display, a leakage transformer, which is as a resonance transformer for driving a display device with higher voltages, is generally used.

For a leakage transformer, as shown in the following Reference 1 for instance, a horizontal-type coil device, to which a scroll axis of coil is arranged parallel to a mounting substrate surface of the coil device, is known. Such horizontal-type coil device has a problem that a leakage flux toward upward and downward directions with respect to the mounting substrate surface is large.

In order to make the leakage flux small, it is considered that top and bottom of the horizontal-type coil device is covered with aluminum board and aluminum foil. However, with this, heat dissipation may be deteriorated.

Further, for other leakage transformer, as shown in the following Reference 2 for instance, a vertical-type coil device, to which a scroll axis of coil is arranged perpendicular to a mounting substrate surface of the coil device, is known. With its configuration, it enables to make the leakage flux toward upward and downward directions with respect to the mounting substrate surface small.

However, the vertical-type coil device has a problem that a stable operation as a resonance transformer is difficult since a primary coil and a secondary coil are arranged to have the same center and a coupling coefficient K is too favorable (for instance, K=0.95 or more). For instance, in the vertical-type coil device, there is a problem that a separation distance between the primary coil and the secondary coil with the same center has to be subtly adjusted and a core for leakage has to be added to the core, in order to achieve a desired leakage characteristic. Therefore, the conventional vertical-type coil device has a problem that a characteristic fluctuation is likely to be generated since the assembling becomes complicated.

[Patent Literature 1] Japanese Patent Application Publication No. 2006-108390

[Patent Literature 2] Japanese Patent Application Publication No. 2005-158927

SUMMARY OF THE INVENTION

The present invention has been made by considering the above circumstances, and a purpose of the present invention is to provide a coil device which enables easily to obtain a desired leakage characteristic and enables easily assembling, and has less characteristic fluctuation.

In order to achieve the above purpose, a coil device according to the present invention comprises, a first bobbin provided with a first hollow cylinder on which a primary coil is wound at the outer periphery, and a second bobbin mounted on said first bobbin and provided with a second hollow cylinder on which a secondary coil is wound at the outer periphery, wherein;

a winding center of said primary coil and that of said secondary coil displace with a predetermined displacement (Lx) along a predetermined reference direction.

Regarding a procedure easily obtaining the desired leakage characteristic, as a result of review, the inventors of the present invention have found out that the leakage characteristic can be varied by displacing the winding center of the primary coil and that of the secondary coil with the predetermined displacement (Lx) along the predetermined reference direction. With this finding, they could achieve the present invention.

Specifically, according to the present invention, it becomes possible easily to obtain the desired leakage characteristic by displacing the winding center of the primary coil and that of the secondary coil with the predetermined displacement (Lx) along the predetermined reference direction. Moreover, a control of the displacement can be realized only by displacing an axis of the outer perimeter shape of the first hollow cylinder wound by the primary coil and an axis of the outer perimeter shape of the second hollow cylinder wound by the secondary coil with the predetermined displacement (Lx). With this, it enables to achieve a coil device which can be easily assembled and has less characteristic fluctuation.

Preferably, said first bobbin and said second bobbin are assembled so that a first through hole of said first hollow cylinder and a second through hole of said second hollow cylinder can communicate with each other. Preferably, a middle leg of a ferrite core is inserted into these first through hole and second through hole. With this structure, it enables easily assembling of coil device.

Preferably, a proportion (Lx/Lo) of said displacement (Lx) with respect to a reference length (LO) of the middle leg of said ferrite core along the reference direction is 0.05 to 0.30 and more preferably, 0.09 to 0.22. If the proportion (Lx/Lo) of this displacement (Lx) is too small, the effect of the present invention becomes less effective. On the other hand, if the proportion (Lx/Lo) is too large, problems such as heat generation occur since a leakage flux becomes too large.

Preferably, said ferrite core is composed of a first core and a second core which are divisible, a first middle leg of said first core fits into the first through hole of said first hollow cylinder, and a second middle leg of said second core fits into the second through hole of said second hollow cylinder. With the above structure, it enables easily assembling of coil device.

Preferably, a combination of said first bobbin and said second bobbin is covered from the outside by base portions and side legs of said first core and second core. With this structure, it enables to prevent a leakage flux. With respect to a reference length (LO) of the middle leg of ferrite core along said reference direction, a width (WO) of base portions and side legs along the reference direction may be the same or different. However, by making it substantially the same, it enables easily adjustment of leakage characteristic.

A cross-section of middle legs of said ferrite core is not particularly limited, and it may be a circular and an elliptical shape. However, if the cross-section of middle legs has an elliptical shape, it is preferable that a major axis direction of this elliptical shape corresponds to said reference direction. It enables easily adjustment of a leakage characteristic by displacing in a major axis direction of elliptical shape.

A core center of middle legs of said ferrite core along said reference direction, a winding center of said primary coil and a winding center of said secondary coil may be mutually displaced each other along said reference direction. However, any two of them may correspond to each other.

With respect to the core center of middle legs of said ferrite core along said reference direction, the winding center of said primary coil and the winding center of said secondary coil may be respectively displaced on the opposite side, along said reference direction. By displacing to the opposite side, the displacement between the winding center of the primary coil and the winding center of the secondary coil can be increased. Further, by displacing to the opposite side, a center of gravity of coil device as a whole gets closer to the center of coil device, and a handling ability is improved.

Said first bobbin and said second bobbin may be assembled so that the first through hole of said first hollow cylinder is connected with the second through hole of said second hollow cylinder, moreover, so that a top of said first hollow cylinder fits into a concave formed at the bottom of said second bobbin plate. With this structure, it enables easily assembling of coil device and also enables a low height profile of coil device.

DESCRIPTION OF THE PREFERRED EMBODIMENTS

The following is the explanation of the present invention based on the embodiments shown in Figures.

As shown in FIGS. 1 and 2A to 2F, coil device 10 according to an embodiment of the present invention comprises a core 12, a first bobbin 40 and a second bobbin 50.

The core 12 of the coil device 10 forms a flux path where flux generated from a coil, which is described later, passes. It is formed by assembling a first core 12*a* and a second core 12*b*, which are separately formed. The first core 12*a* and the second core 12*b* have a symmetrical shape and they are attached to each other, sandwiching the second bobbin 50 and first bobbin 40 from upward and downward directions (Z-axis direction in FIG. 1).

Figure 3A:
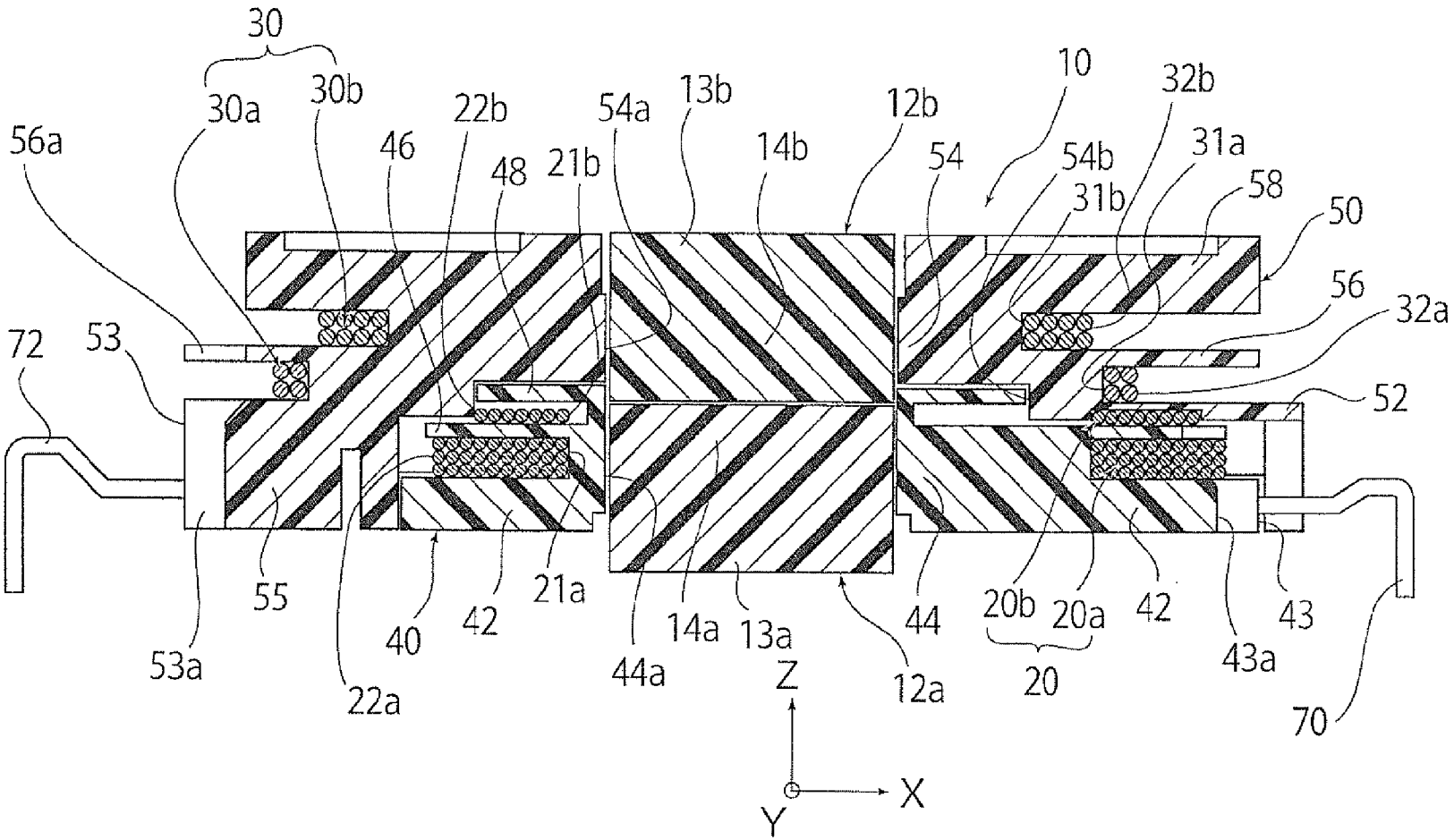
FIG. 3A is a cross-sectional view along IIIA-IIIA of coil device shown in FIG. 1.
Figure 3B:
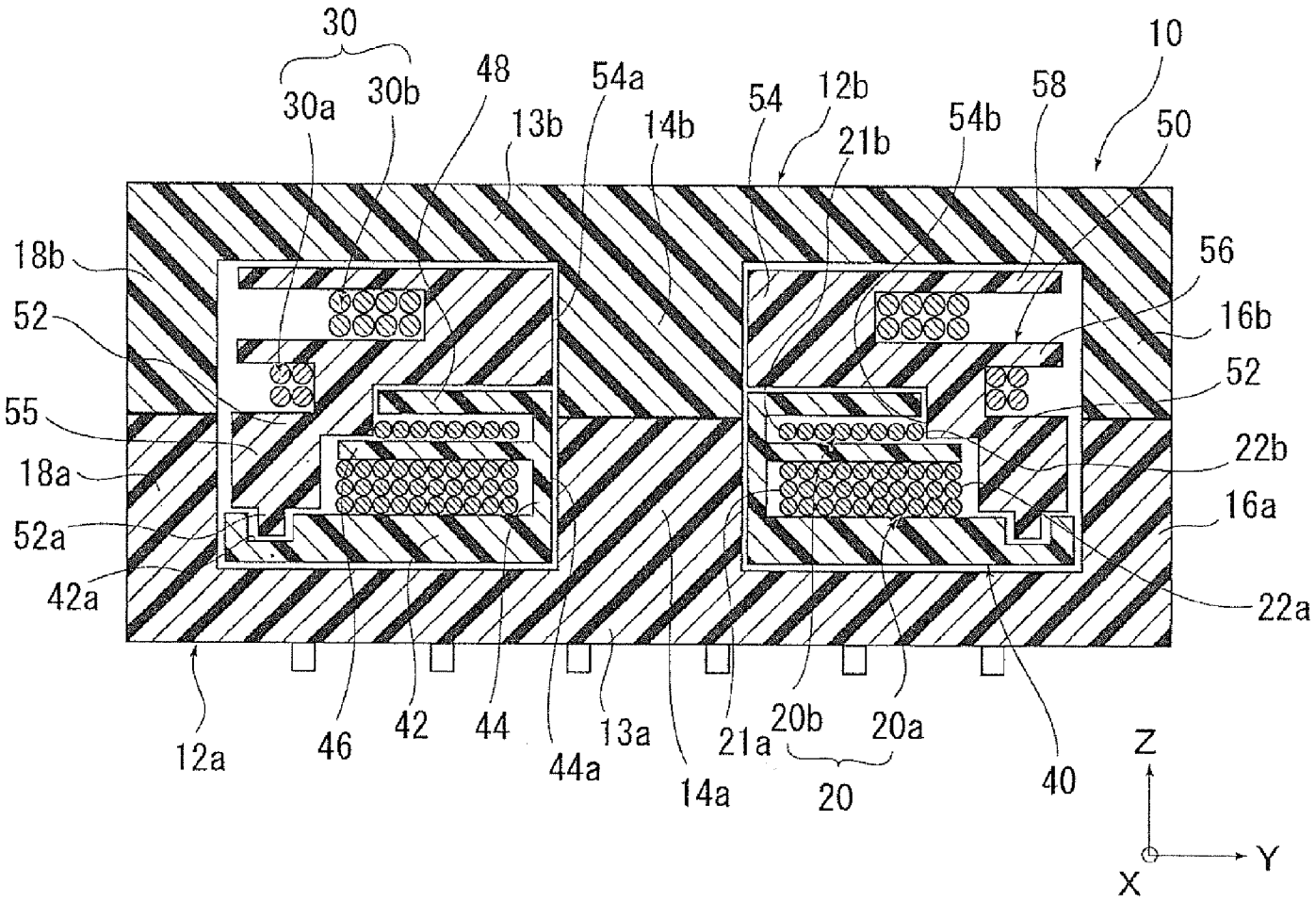
FIG. 3B is a cross-sectional view along IIIB-IIIB of coil device shown in FIG. 1.

As shown in FIG. 3B, the core 12 comprises the first core 12*a* and the second core 12*b* respectively having a substantially E-shaped cross-section (cut section including Y-axis and Z-axis). Each core 12*a*, 12*b* is composed of ferrite core, and comprises planar base portions 13*a*, 13*b* extending in the Y-axis direction, side legs 16*a*, 16*b*, 18*a*, 18*b* projecting from both ends of Y-axis direction of each base portions 13*a*, 13*b* to the Z-axis direction and middle legs 14*a*, 14*b* projecting from an intermediate position of Y-axis direction of each base portions 13*a*, 13*b* to the Z-axis direction.

Further, in Figures, Z-axis shows a height direction of the coil device 10, and it enables low height profile of the coil device as the height of Z-axis direction of the coil device 10 becomes lower. Furthermore, Y-axis and X-axis are perpendicular to each other and also are perpendicular to Z-axis. In this embodiment, X-axis corresponds to a longitudinal direction of coil device 10 and Y-axis corresponds to a longitudinal direction of base portions 13*a*, 13*b* of ferrite core 12.

Figure 4:
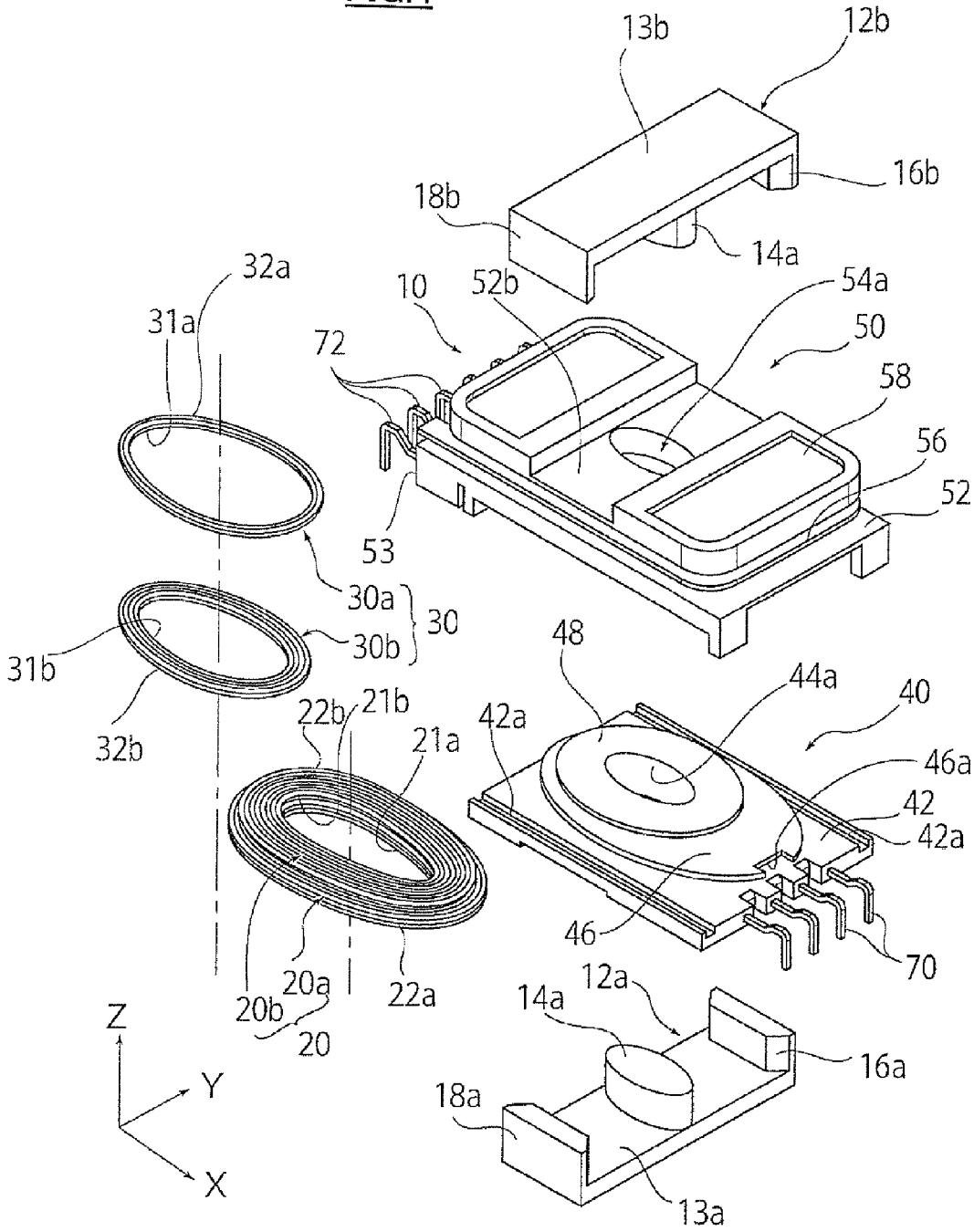
FIG. 4 is an exploded perspective view of coil device shown in FIG. 1.

As shown in FIG. 4, the first bobbin 40 comprises a rectangular planar first bobbin plate 42. A bottom side of the first bobbin plate 42 is a mounting surface (mounting substrate surface) for the coil device. On one end portion 43 of the X-axis direction of the first bobbin plate 42, plural primary terminals 70 (in an illustrative embodiment, 4 primary terminals are fixed) are fixed at predetermined intervals along the Y-axis direction. Further, on the other end portion of the X-axis direction of the first bobbin plate 42, terminals are not formed. However, on the other end portion 53 of the X-axis direction of the second bobbin 50, secondary terminals 72 are formed.

These terminals 70 and 72 are composed of, for instance, metal terminal and they are integrally formed by an insert molding procedure and the like with respect to the first bobbin plate 42 and the second bobbin plate 52 which are composed of insulation materials such as synthetic resins. As described later, a lead part of a primary coil 20 (illustration omitted) is connected to the primary terminal 70, and a lead part of a secondary coil 30 (illustration omitted) is connected to a secondary terminal 72.

As shown in FIGS. 3A and 3B, a first hollow cylinder 44 is formed projecting in the Z-axis direction on a substantially intermediate position of the surface of the first bobbin plate 42. A first bobbin upper collar part 48 is formed on the upper end of the first hollow cylinder 44. The first bobbin upper collar part 48 projects, along the plane of the Y-X axis from the first hollow cylinder 44 in a radial direction, and has a function to hold the primary coil 20. At an outer perimeter of the first hollow cylinder 44 which is located between the first bobbin upper collar part 48 and the first bobbin plate 42, a first bobbin intermediate collar part 46 or more, which dividing and placing the primary coil 20 along the Z-axis direction, may be formed parallel to the first bobbin upper collar part 48.

It is preferable that the first bobbin plate, the first hollow cylinder 44, the first bobbin upper collar part 48 and the first bobbin intermediate collar part 46 of first bobbin 40 are integrally formed by an injection molding and the like. A first through hole 44*a*, penetrating in the Z-axis direction, is formed inside the first hollow cylinder 44 of the first bobbin plate 42. A cross-sectional shape of the first through hole 44*a* corresponds to that of a second through hole 54*a* which is formed on a second bobbin 50 described later. Further, the cross-section has an elliptical shape that allows middle leg 14*a* (the same with 14*b*/hereinafter the same) on a core 12*a* (the same with 12*b*/hereinafter the same) to insert.

The primary coil 20 is wound on the outer perimeter of the first hollow cylinder 44. The first hollow cylinder 44 functions as a first bobbin body of the primary coil 20, and is divided into two coils 20*a*, 20*b* by the first bobbin intermediate collar part 46. However, the present invention is not limited to the above, and the first hollow cylinder 44 may be divided into 2 coils or more, or may be a single coil.

Figure 5:
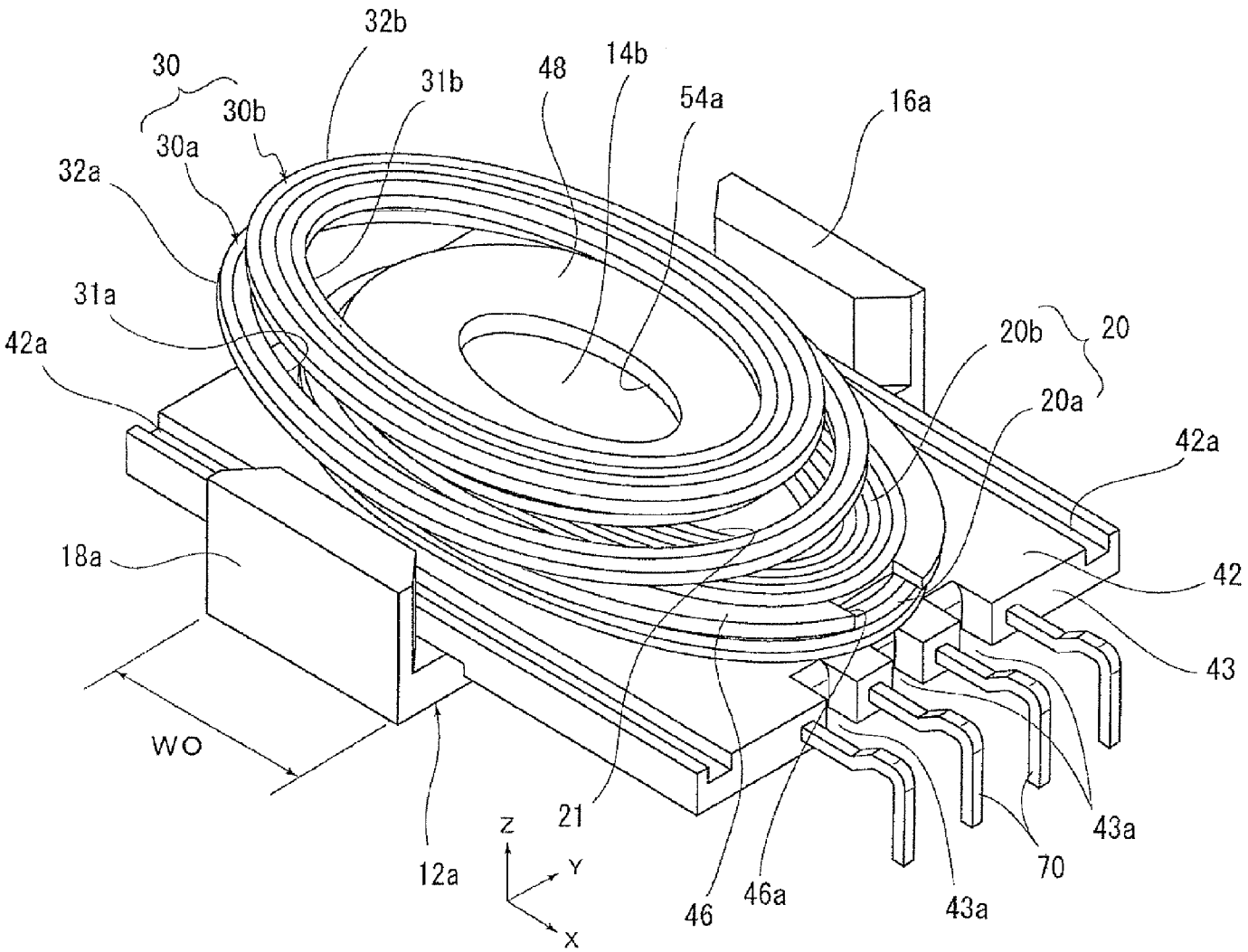
FIG. 5 is a partially omitted perspective view of coil device shown in FIG. 1.
Figure 6:
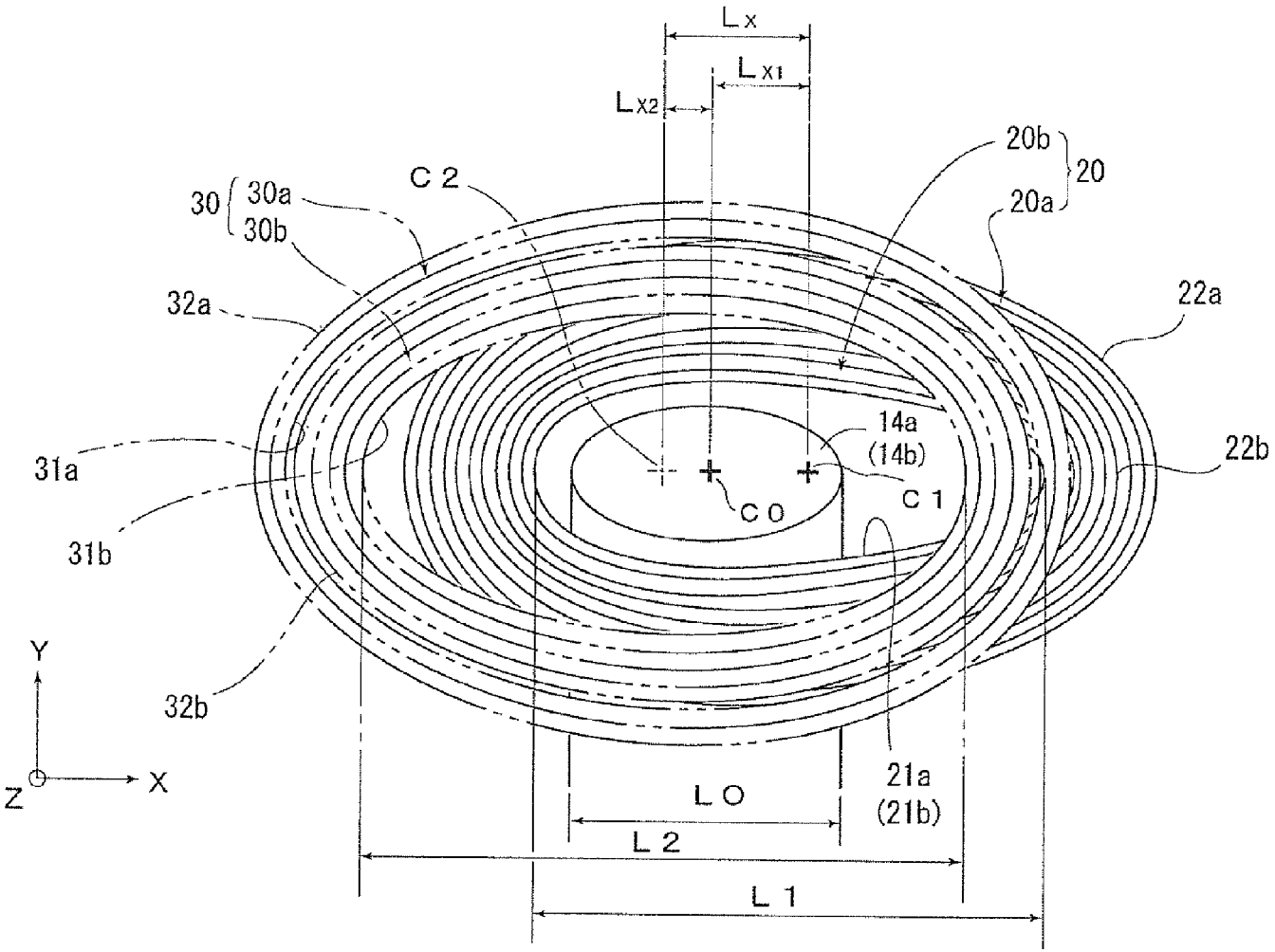
FIG. 6 is a top view showing a positional relation among middle legs of ferrite core, primary coil and secondary coil.

As shown in FIGS. 4 to 6, an inner perimeter edge 21*a* of at least one primary coil 20*a* of the primary coil 20 corresponds to an outer perimeter shape of the first hollow cylinder 44. In a top view shown in FIG. 6, the inner perimeter edge has an egg-shape, such as deforming an ellipse so that the curvature of both ends of its major axis direction becomes asymmetric. In the present embodiment, a shape of an inner perimeter edge 21*b* of other primary coil 20*b* is the same with that of the inner perimeter edge 21*a* of another primary coil 20*a*. However, it may not necessarily be the same.

As shown in cross-sections of FIGS. 3A and 3B, outer perimeter edges 22*a*, 22*b* of the primary coils 20*a*, 20*b* are formed to fit in a sidewall 55 extending from the outer perimeter edge of a second bobbin plate 52 which will be described later to a downward in the Z-axis direction.

As shown in FIGS. 4 and 5, on the upper surface of both sides of Y-axis direction of the first bobbin plate 42, a concave groove 42*a*, wherein a convex portion 52*a* formed downward in the Z-axis direction of the sidewall 55 shown in FIG. 3 removably fit, is formed along the X-axis direction.

As shown in FIGS. 3A, 3B and 4, a second bobbin 50 holds a secondary coil 30 and also defines a part of an outer shape of the coil device 10. The second bobbin 50 comprises a second hollow cylinder 54 on which the secondary coil 30 is wound. The second hollow cylinder 54 functions as a bobbin body of the secondary coil 30.

In the second hollow cylinder 54, a second through hole 54*a* connecting to the first through hole 44*a* of the first hollow cylinder 44 is formed. The second through hole 54*a* allows middle leg 14*b* of a second core 12*b* to insert.

On the upper end of Z-axis direction of the second hollow cylinder 54, a second bobbin upper collar part 58 is formed along the plate surface of Y-X axes. The second bobbin upper collar part 58 is mounted parallel to the second bobbin plate 52 of the second bobbin 50 which is mounted opposing to the first bobbin plate 42 of the first bobbin 40, and is extended in parallel with the mounting surface.

In the central part of the second bobbin upper collar part 58, the upper end of the second through hole 54*a* is opened to insert the middle leg 14*b* of the second core 12*b*. Further, on the second bobbin upper collar part 58, an installation groove 52*b* is formed to mount a base portion 13*b* of second core 12*b*.

The second hollow cylinder 54 of the second bobbin 50 projects perpendicularly from the under surface of the second bobbin upper collar part 58 toward downward in the Z-axis direction. At the lower end of Z-axis direction of the second hollow cylinder 54, a rectangular second bobbin plate 52 which is a little larger than the first bobbin plate 42 is formed along the plane surface of Y-X axes. The second bobbin plate 52 is mounted so as to cover the upper surface of the first bobbin plate 42.

At both ends of the Y-axis direction of the second bobbin plate 52, as previously described, the sidewall 55 projecting downward of the Z-axis direction is formed. At the lower end of the sidewall 55, a convex portion 52*a* which engages with the concave groove 42*a* of the first bobbin 40 is formed.

At an outer periphery of the second hollow cylinder 54 which is located between the second bobbin upper collar part 58 and the second bobbin plate 52, a second bobbin intermediate collar part 56 or more, which dividing and placing the secondary coil 30 along the Z-axis direction, may be provided parallel to the second bobbin upper collar part 58 in accordance with the use of coil device 10 and the like.

A receiving concave 54*b*, which enables the first bobbin upper collar part 48 formed on the top of the first hollow cylinder 44 to insert, is formed on the bottom of the second bobbin plate 52, where the second bobbin plate 52 intersects with the second bobbin hollow cylinder 54. The shape of inner diameter of the receiving concave 54*b* is larger than that of the second through hole 54*a*. The shape of inner diameter of the receiving concave 54*b* corresponds to the shape of the first bobbin upper collar part 48, and it covers a periphery of the first bobbin upper collar part 48 and also covers an outer periphery of some first coils 20*b*.

The second bobbin 50, which is composed of these collar parts 56, 58, second hollow cylinder 54, plate 52 and sidewall 55, is integrally formed by an injection molding and the like.

The coil device 10 of the present embodiment has a vertical structure wherein the primary coil 20 and the secondary coil 30 are divided in the Z-axis direction and arranged at a periphery of middle legs 14*a* (14*b*) of core 12*a* (12*b*).

The outer perimeter shape of the second hollow cylinder 54 has an appropriate shape to wind each divided coil 30*a*, 30*b* of the secondary coil 30 shown in FIGS. 4 to 6 into an elliptical shape or other shapes having a predetermined inner periphery. As shown in FIGS. 3A and 3B, an inner perimeter edge 31*a* of the divided coil 30*a* has a shape contacting an outer periphery of the hollow cylinder 54 which is located between the second bobbin plate 52 and the intermediate collar part 56. Further, an inner perimeter edge 31*b* of the other divided coil 30*b* has a shape contacting an outer periphery of the hollow cylinder 54 which is located between the intermediate collar part 56 and the upper collar part 58. Furthermore, an outer perimeter edge 32*a* of the divided coil 30*a* has a larger outer diameter than the outer perimeter edge 32*b* of the other divided coil 30*b*.

In the present embodiment, the secondary coil 30 is composed of two independent coils. However, the secondary coil 30 may be composed of a single coil, and also it may be composed of 3 coils or more.

As shown in FIG. 5, a tip end portion of the first bobbin intermediate collar part 46 of the X-axis direction extends to around the other end portion 43 of the first bobbin plate 42 of the X-axis direction wherein the primary terminals 70 are formed. On this tip end portion, a guiding notch 46*a*, which guides a lead wire of the primary coil 20*b* arranged on the upper side of the first bobbin intermediate collar part 46, is formed.

Further, on one end portion 43 of the first bobbin plate 42 of the X-axis direction wherein the primary terminals 70 are formed, guiding concaves 43*a* are formed among the primary terminals 70. With this, lead wires of the primary coils 20*a*, 20*b* can be guided to the direction of the primary terminals 70.

As shown in FIG. 3A, a tip end portion of the second bobbin intermediate collar part 56 of the X-axis direction extends to around the other end portion 53 of the second bobbin plate 42 of the X-axis direction wherein the secondary terminals 72 are formed. On this tip end portion, a guiding notch 56*a*, which guides a lead wire of the secondary coil 30*b* arranged on the upper side of the second bobbin intermediate collar part 56 in the direction of the secondary terminal 72, is formed.

Figure 2A:
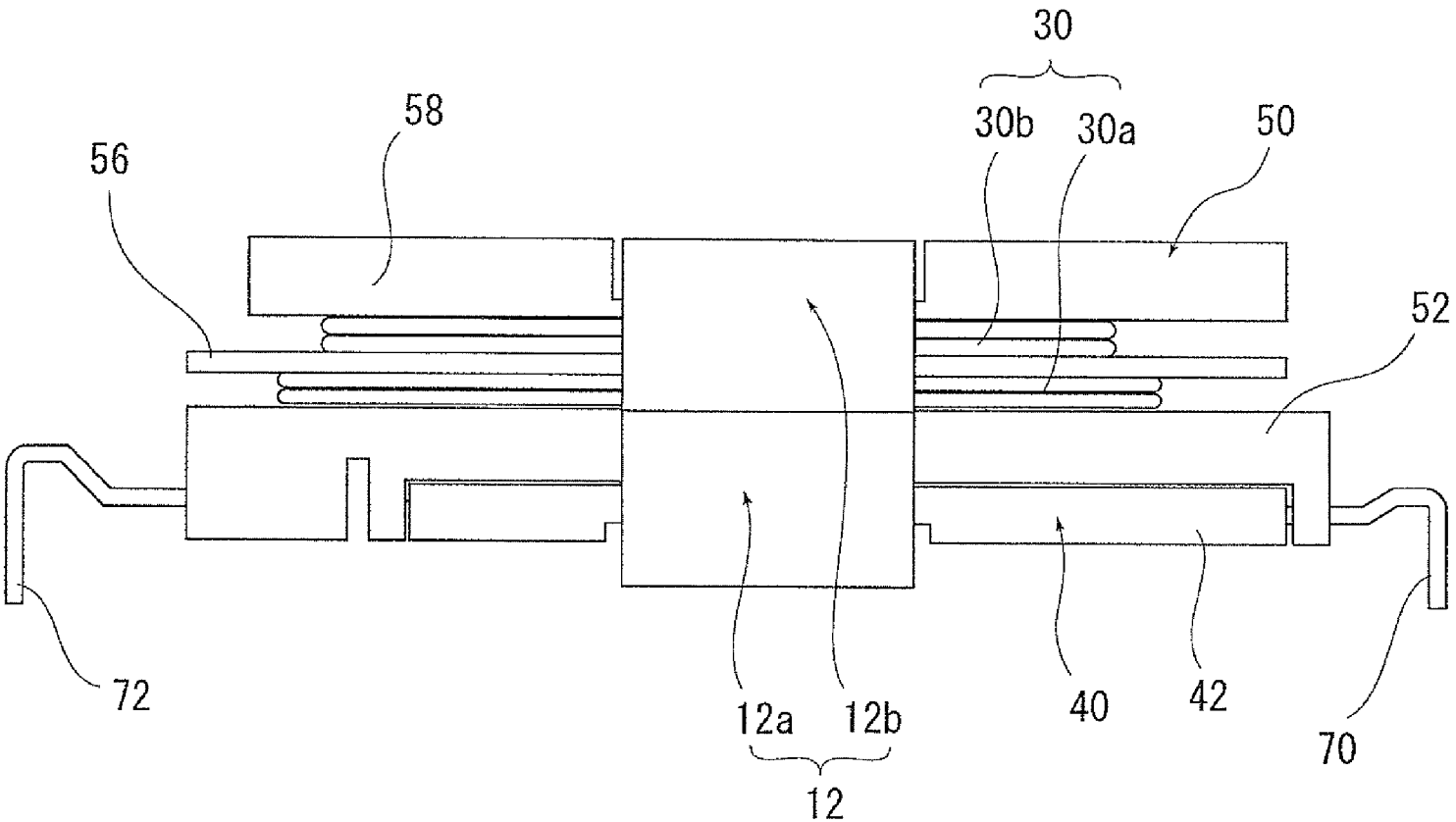
FIG. 2A is a front view of coil device shown in FIG. 1.
Figure 2B:
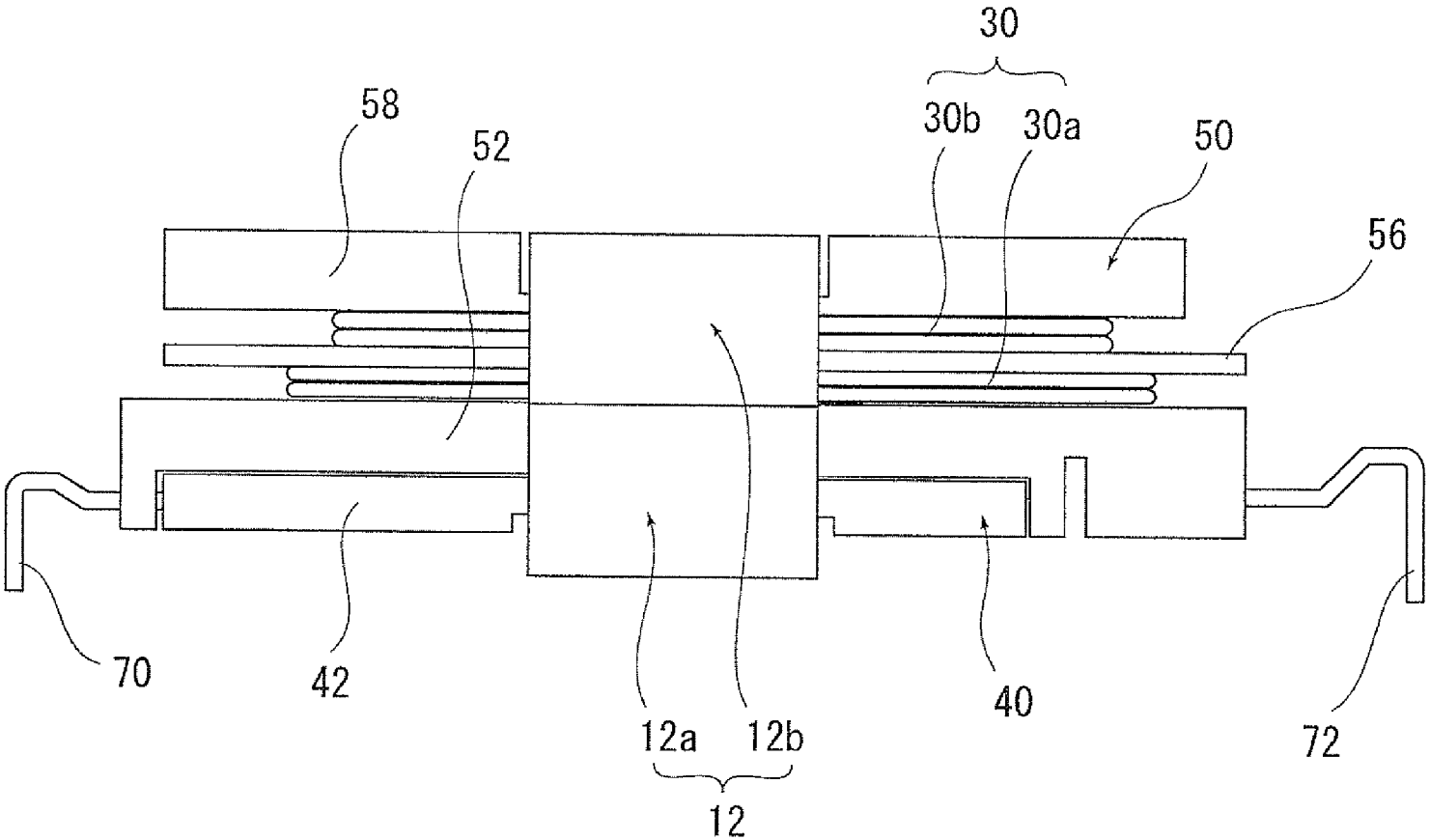
FIG. 2B is a rear view of coil device shown in FIG. 1.
Figure 2C:
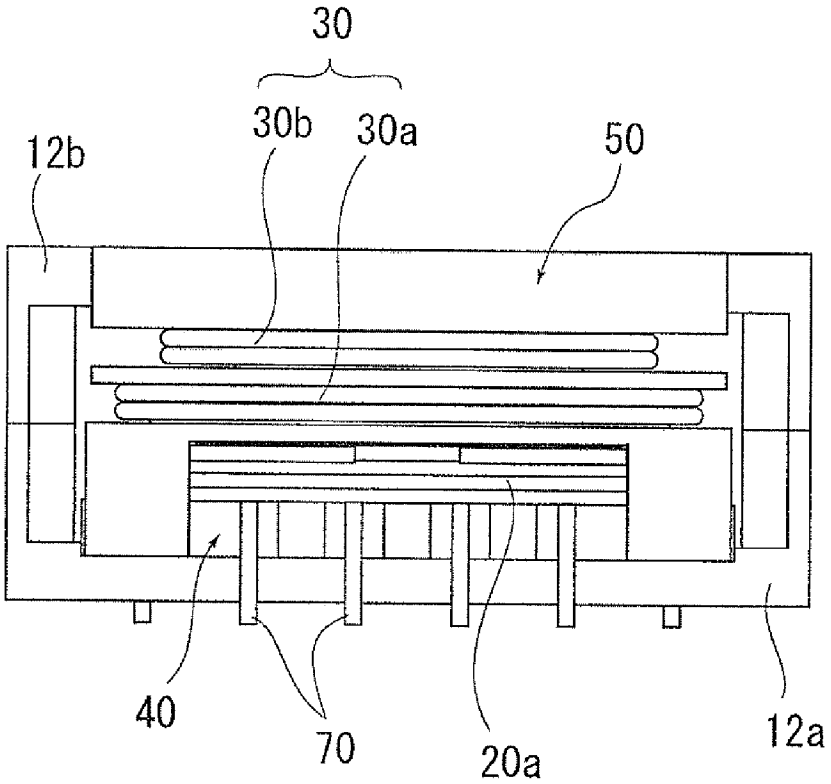
FIG. 2C is a right side view of coil device shown in FIG. 1.
Figure 2D:
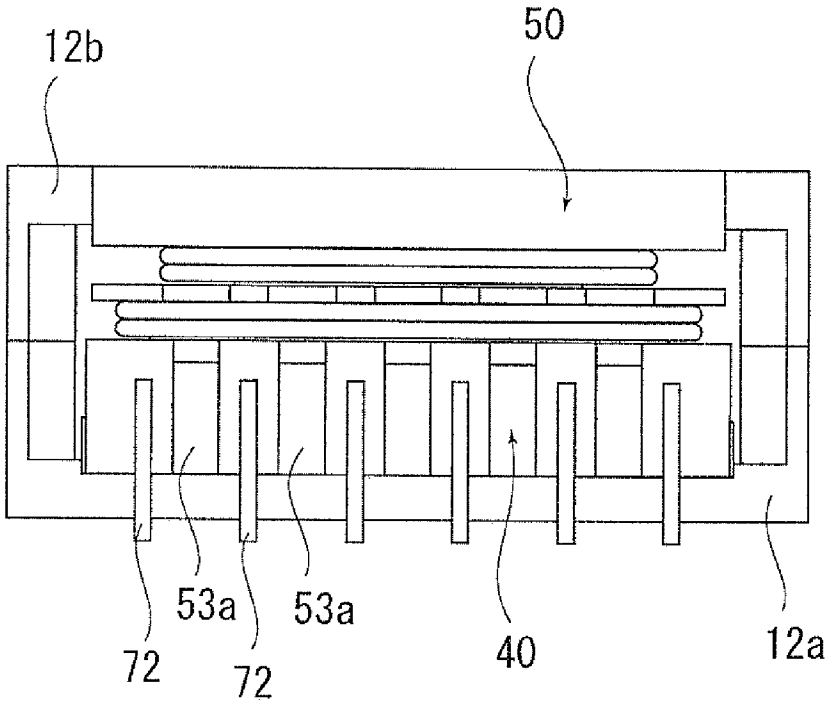
FIG. 2D is a left side view of coil device shown in FIG. 1.
Figure 2E:
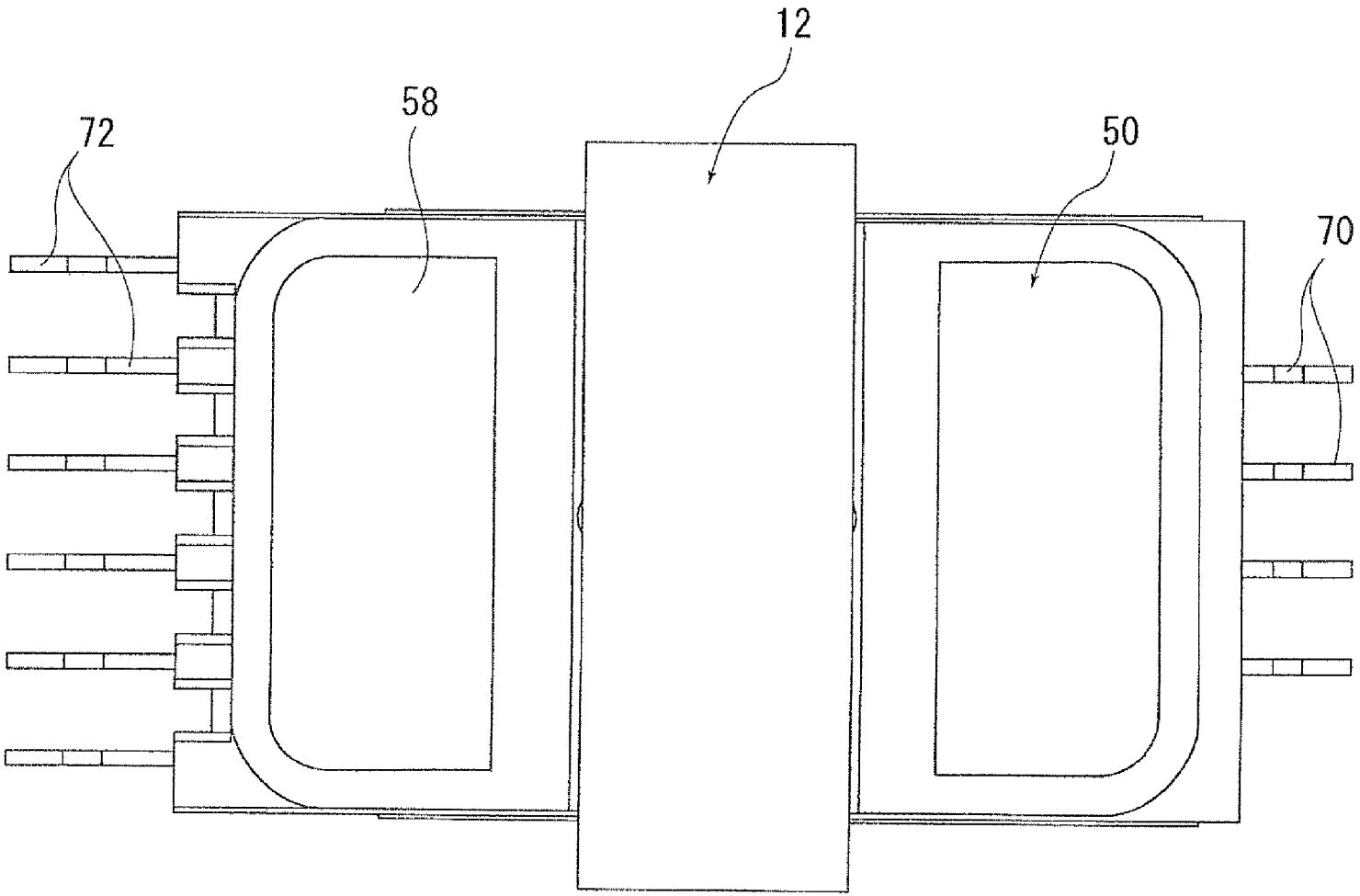
FIG. 2E is a top view of coil device shown in FIG. 1.
Figure 2F:
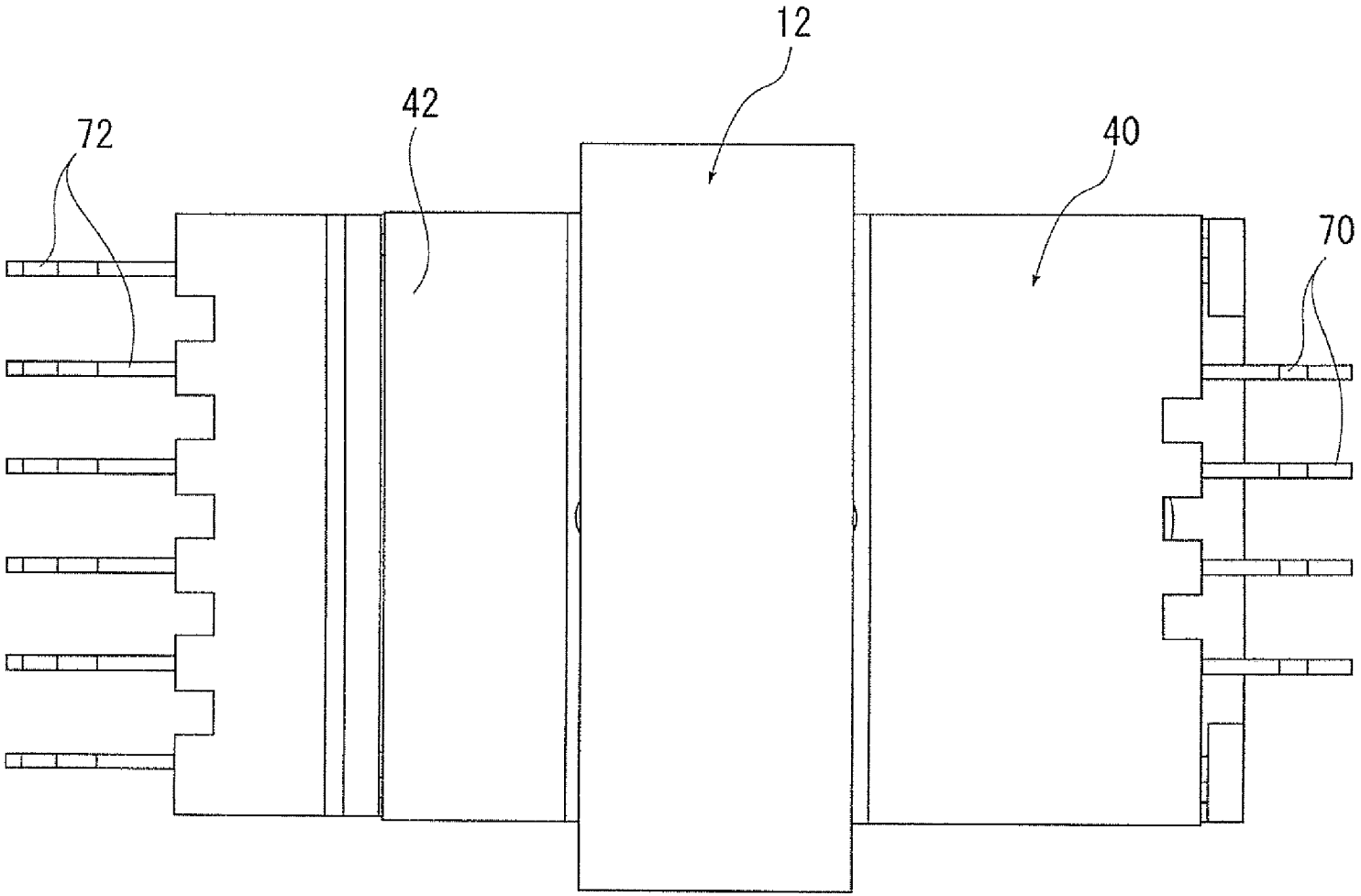
FIG. 2F is a bottom view of coil device shown in FIG. 1.

As shown in FIGS. 3A and 2D, on the other end portion 53 of the second bobbin plate 52 of the X-axis direction wherein the secondary terminals 72 are formed, a guiding concave 53*a* is formed among the secondary terminals 72. With this, lead wires of the secondary coils 30*a*, 30*b* can be guided to the direction of the secondary terminals 72.

In the present embodiment, as shown in FIG. 6, there is a feature that a winding center C1 of the primary coil 20 and a winding center C2 of the secondary coil 30 displace along a predetermined reference direction (in this embodiment, it is X-axis direction) with predetermined displacement (Lx). Further, the winding center C1 of the primary coil 20 and the winding center C2 of the secondary coil 30 can be achieved as follows, for instance.

In the present embodiment, the primary coil 20 has an egg-shape which is nearly an ellipse shape having a major axis in the X-axis direction. For the inner perimeter edge 21*a* of the primary coil 20*a* which is one of the primary coil 20 having a larger number of turns, a length L1 of the X-axis direction can be obtained. A center of the length L1 of the X-axis direction shall be deemed a winding center C1 of the primary coil 20*a*. In the present embodiment, the inner perimeter edge 21*b* of the primary coil 20*b*, which has less number of turns compared with the primary coil 20*a*, corresponds to the shape of the inner perimeter edge 21*a* of the primary coil 20*a*. Therefore, the winding center is the same as the winding center C1 of the primary coil 20*a*. If the primary coil is divided into more than two and the winding center differs, the weighted average according to the number of turns may be deemed a winding center.

Further, for the secondary coil 30, it is the same with the secondary coil 20 and can be achieved as follows.

In the present embodiment, the secondary coil 30 has an elliptical shape having a major axis in the X-axis direction. For the inner perimeter edge 31*b* of the secondary coil 30*b* which is one of the secondary coil 30 having a larger number of turns, a length L2 of the X-axis direction can be obtained. A center of the length L2 of the X-axis direction shall be deemed a winding center C2 of the secondary coil 30*b*. In the present embodiment, the inner perimeter edge 31*a* of the secondary coil 30*a* which has less number of turns compared with the secondary coil 30*b* has the same center with the inner perimeter edge 31*b* of the secondary coil 30*b*. Therefore, the winding center is the same as the winding center C2 of the secondary coil 30*b*. If the secondary coil is divided into more than two and the winding center differs, the weighted average according to the number of turns may be a winding center.

Further, in the present embodiment, although the X-axis direction shall be deemed a reference direction and a winding center is displaced in the X-axis direction, the same effect can be achieved even if the winding center is displaced in the other direction. However, in order to make a coil device 10 as a whole more compact, it is preferable that two or more of the followings, a major axis direction of elliptically-shaped middle leg 14*a* (14*b*), a major axis direction of substantially elliptically-shaped coils 20 and 30 and a displacement direction of the winding center, mutually correspond.

In the present embodiment, a proportion (Lx/Lo) of said displacement Lx with respect to a reference length LO of middle legs 14*a*, 14*b* of ferrite core along the X-axis direction is preferably 0.05 to 0.30, and more preferably 0.09 to 0.22. If the proportion (Lx/Lo) of this displacement is too small, the effect of the present embodiment becomes less effective. Further, if the proportion (Lx/Lo) is too large, problems such as heat generation by a leakage flux occur since the leakage flux becomes too large.

In the present embodiment, a ferrite core 12 is composed of a first core 12*a* and a second core 12*b* which are divisible, a first middle leg 14*a* of the first core 12*a* fits into a first through hole 44*a* of the first hollow cylinder 44, and a second middle leg 14*b* of the second core 12*b* fits into a second through hole 54*a* of the second hollow cylinder 54. With the above structure, it enables easily assembling of coil device 10.

Further in the present embodiment, a combination of a first bobbin 40 and a second bobbin 50 is covered from the outside by base portions 13*a*, 13*b* and side legs 16*a*, 16*b*, 18*a*, 18*b* of the first core 12*a* and the second core 12*b*. With this structure, it enables to prevent a leakage flux. In addition, in the present embodiment, with respect to a reference length LO of middle legs 14*a*, 14*b* of ferrite core 12 along the X-axis direction, widths WO (refer to FIG. 5) of base portions 12*a*, 12*b* and side legs 16*a*, 16*b*, 18*a*, 18*b* along the X-axis direction may be the same or different. However, by making it substantially the same, it enables easily adjustment of leakage characteristic.

Further, a cross-section of middle legs 14*a*, 14*b* of ferrite core 12 is not particularly limited, and it may be a circular and an elliptical shape. However, if the cross-section of middle legs has an elliptical shape, it is preferable that a major axis direction of this elliptical shape corresponds to the X-axis direction. By displacing in a major axis direction of elliptical shape, it enables easily adjustment of leakage characteristic.

Further, in the present embodiment, as shown in FIG. 6, a core center C0 of middle legs 14*a*, 14*b* of ferrite core along the X-axis direction, a winding center C1 of the primary coil 20, and a winding center C2 of the secondary coil 30 may be mutually displaced each other. However, any two of them may correspond to each other.

Especially, with respect to the core center C0 of middle legs 14*a*, 14*b* of ferrite core along the X-axis direction, the winding center C1 of the primary coil 20 and the winding center C2 of the secondary coil 30 may be respectively displaced on the opposite side, along the X-axis direction.

For instance, the total of a distance Lx1 of the winding center C1 of the primary coil 20 with respect to the core center C0 and a distance Lx2 of the winding center C2 of the secondary coil 30 with respect to the core center C0 may be a displacement Lx. By displacing to the opposite side, the displacement Lx between the winding center C1 of the primary coil and the winding center C2 of the secondary coil can be increased. Further, by displacing to the opposite side, a center of gravity of coil device 10 as a whole gets closer to a center of coil device 10 and a handling ability is improved.

Further, in the present embodiment, a first bobbin 40 and a second bobbin 50 are assembled so that a first through hole 44*a* of the first hollow cylinder 44 is connected with a second through hole 54*a* of the second hollow cylinder 54, moreover, so that a top of the first hollow cylinder 44 fits into a concave 54*b* which is formed at the bottom of the second bobbin plate 52. With this structure, it enables easily assembling of coil device 10 and also enables a low height profile of coil device 10.

According to the present embodiment, it becomes possible easily to obtain the desired leakage characteristic by displacing the winding center C1 of the primary coil 20 and the winding center C2 of the secondary coil 30 with the predetermined displacement (Lx) along the predetermined reference direction. Moreover, a control of the displacement Lx can be realized only by displacing an axis of the outer perimeter shape of the first hollow cylinder 44 wound by the primary coil 20 and an axis of the outer perimeter shape of the second hollow cylinder 54 wound by the secondary coil 30 with the predetermined displacement Lx. With this, it enables to achieve a coil device 10 which can be easily assembled and has less characteristic fluctuation.

For instance, compared with an inductance Lr showing the leakage characteristic of conventional coil device wherein the displacement Lx is equal to 0, in the case of coil device of the present embodiment wherein a proportion of the displacement Lx/Lo is 0.09 to 0.22, the inductance Lr increases by 1.7 to 2.4 times. By using it as a resonance transformer, it enables to achieve a preferable leakage transformer. Further, with the structure of coil device of the present embodiment, it enables to control losses due to heat generation since the structure of the present embodiment has basically less leakage flux.

In addition, regarding a coupling coefficient K, compared with the conventional coil device wherein the displacement Lx is equal to 0, in the case of coil device of the present embodiment wherein a proportion of the displacement Lx/Lo is 0.09 to 0.22, the coupling coefficient K is 0.95 to 0.92 times. By using it as a resonance transformer, it enables to achieve a preferable leakage transformer.

Coil device 10 according to the present embodiment is produced by assembling each part shown in FIG. 4 and by winding wires around the first bobbin 40 and the second bobbin 50. The following is the explanations about an example of producing method of coil device 10 by use of FIG. 4 and so on. When producing coil device 10, firstly, a first bobbin 40 mounted with a primary terminal 70 and a secondary terminal 72 is prepared. Although materials of the first bobbin 40 are not particularly limited, the first bobbin 40 is formed with an insulation material such as resin.

Next, wires are wound around the first hollow cylinder 44 of the first bobbin 40 to form the primary coil 20. Although wires used to form the primary coil 20 is not particularly limited, litz wire and the like are preferably used. Further, a primary lead wire, which is a terminal portion of the wire when forming the primary coil 20 is tangled with the primary terminal 70 to connect (illustration omitted).

Next, the second bobbin 50 shown in FIG. 2 is mounted on the first bobbin 40 wherein the primary coil 20 is formed. At the outer periphery of the second hollow cylinder 54 of the second bobbin 50, the secondary coil 30 is wound.

As shown in FIG. 3B, the second bobbin 50 and the first bobbin 40 are assembled by engaging a convex portion 52*a* formed at the bottom of sidewall 55 of the second bobbin plate 52 into a concave groove 42*a* formed on the surface of the first bobbin plate 42. Further, the second bobbin 50 and the first bobbin 40 are fixed by bonding adhesive and so on as necessary.

Next, the first core 12*a* and the second core 12*b* of core 12 are mounted to an intermediate assembly, wherein the primary coil 20, the secondary coil 30, the second bobbin 50 and the first bobbin 40 are assembled, from the vertical direction of Z-axis direction to form core 12. Specifically, tip ends of middle legs 14*a*, 14*b*, tip ends of side legs 16*a*, 16*b* and tip ends of side legs 18*a*, 18*b* of the first core 12*a* and the second core 12*b* are connected together. Further, there may be a gap between tip ends of middle legs 14*a* and 14*b*.

As for a material of core 12, soft magnetic material such as metal, ferrite and the like are exemplified. However, it is not particularly limited. The first core 12*a* and the second core 12*b* of core 12 are connected together by using a bonding adhesive, or their outer periphery is wound by a tape, in order to fix to the second bobbin 50 and the first bobbin 40. Note that, after a set of assembly process, varnish impregnation may be performed to coil device 10. With these processes, coil device 10 according to the present embodiment can be produced.

Figure 1:
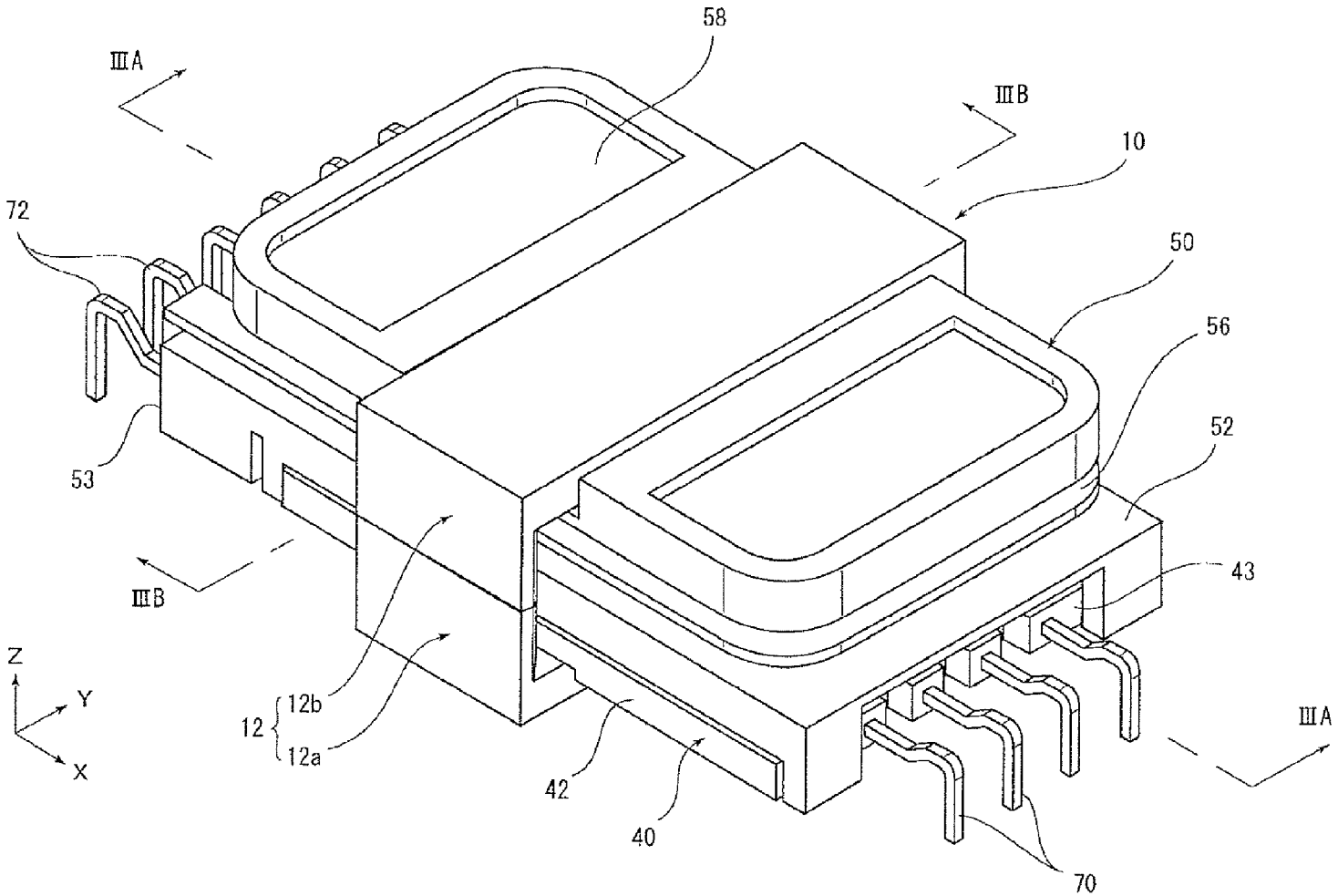
FIG. 1 is an overall perspective view of coil device according to an embodiment of the present invention.

As shown in FIG. 5, the coil device 10 is a vertical type, wherein the Z-axis direction (flux flowing direction) of middle legs 14*a* (14*b*) is vertical to the mounting surface. For the vertical type of coil device 10, as shown in FIGS. 1, 3A and 3B, base portions 13*a*, 13*b* of core 12 are placed upward and downward directions of the Z-axis of the primary and the secondary coils 20, 30, and that these base portions 13*a*, 13*b* suppress leakage flux toward upward and downward directions. Therefore, leakage flux of coil device 10 toward upward and downward directions can be suppressed, compared to a horizontal type wherein upward and downward directions of coil are hardly shielded by core.

Therefore, the coil device 10 can prevent occurrence of eddy current on surrounding constructional materials and the like, without implementing aluminum shield and the like. Further, by preventing occurrence of eddy current, the coil device 10 can decrease occurrence of heat or noise associated with said occurrence of eddy current. Further, the coil device 10 does not require a shield to shield leakage flux, and therefore it can obtain a favorable heat dissipation characteristic. Furthermore, the coil device 10 provides short length middle leg 14 and side legs 16, 18 of core, and that enables to prevent damages of core 12 caused by external impact and the like.

Further, in the above mentioned embodiments, although a cross-sectional shape of middle leg 14*a* (14*b*) of core 12 is an ellipse shape, it is not particularly limited and may be a circular, polygonal or other shapes. Furthermore, for a winding shape of the primary coil 20 and the secondary coil 30, it is not particularly limited and it also may be a circular, polygonal or other shapes. In addition, for the primary coil 20 and the secondary coil 30, they do not need to have the same elliptical shape. For instance, one may be an elliptical shape and the other may be a circular shape.

In addition, the terms "primary" and "secondary" for coils, lead wires and terminals are used for a reason of expediency. In the present invention, a coil attached to the first bobbin 40 is referred to as a primary coil, and a coil attached to the second bobbin is referred to as a secondary coil. The primary coil does not need to be an input side, it may be an output side and the secondary coil may be an input side.

Further, in the above-mentioned embodiment, although the coil device is formed by assembling the first bobbin 40 and the second bobbin 50 from upward and downward direction of the Z-axis direction, it is not particularly limited. For instance, coil device may have a slide assembly structure that a receiving concave opening in a horizontal direction is formed on either of the first bobbin 40 or the second bobbin 50, and the other of the first bobbin 40 or the second bobbin 50, is assembled to the receiving concave by sliding from the horizontal direction.

10—coil device
12—core
12*a*—first core
12*b*—second core
13*a*, 13*b*—base portion
14*a*, 14*b*—middle leg
16*a*, 16*b*, 18*a*, 18*b*—side leg
20, 20*a*, 20*b*—primary coil
21*a*, 21*b*—primary coil inner perimeter edge
22*a*, 22*b*—primary coil outer perimeter edge
30,30*a*, 30*b*—secondary coil
31*a*, 31*b*—secondary coil inner perimeter edge
32*a*, 32*b*—secondary coil outer perimeter edge
40—first bobbin
42—first bobbin plate
44—first hollow cylinder
44*a*—through hole
46—first bobbin intermediate collar part
48—first bobbin upper collar part
50—second bobbin
52—second bobbin plate
54—second hollow cylinder
54*a*—through hole
56—second bobbin intermediate collar part
58—second bobbin upper collar part
70—primary terminal
72—secondary terminal

The invention claimed is:

1. A coil device comprising;

a first bobbin provided with a first hollow cylinder on which a primary coil is wound at the outer periphery, and a second bobbin mounted on said first bobbin and provided with a second hollow cylinder on which a secondary coil is wound at the outer periphery, wherein; a winding center of said primary coil and a winding center of said secondary coil displace with a predetermined displacement along a predetermined reference direction;

said first bobbin and said second bobbin are assembled so that a first through hole of said first hollow cylinder is connected with a second through hole of said second hollow cylinder, a middle leg of a ferrite core is inserted into these first through hole and second through hole, and a proportion of said predetermined displacement with respect to a predetermined reference length of the middle leg of said ferrite core along said predetermined reference direction is 0.05 to 0.30.

2. The coil device as set forth in claim 1, wherein;

said ferrite core is composed of a first core and a second core which are divisible, a first middle leg of said first core fits into a first through hole of said first hollow cylinder, a second middle leg of said second core fits into a second through hole of said second hollow cylinder, and a combination of said first bobbin and said second bobbin is covered from the outside by base portions and side legs of said first core and second core.

3. The coil device as set forth in claim 1, wherein;

a cross-section of middle legs of said ferrite core has an elliptical shape, and a major axis direction of this elliptical shape corresponds to said reference direction.

4. The coil device as set forth in claim 2, wherein;

a cross-section of middle legs of said ferrite core has an elliptical shape, and a major axis direction of this elliptical shape corresponds to said reference direction.

5. The coil device as set forth in claim 1, wherein;

the winding center of said primary coil and the winding center of said secondary coil respectively displace along said reference direction with respect to a core center of middle legs of said ferrite core along said reference direction.

6. The coil device as set forth in claim 2, wherein;

the winding center of said primary coil and the winding center of said secondary coil respectively displace along said reference direction with respect to a core center of middle legs of said ferrite core along said reference direction.

7. The coil device as set forth in claim 3, wherein;

the winding center of said primary coil and the winding center of said secondary coil respectively displace along said reference direction with respect to a core center of middle legs of said ferrite core along said reference direction.

8. The coil device as set forth in claim 5, wherein;

the winding center of said primary coil and the winding center of said secondary coil respectively displace along said reference direction with respect to a core center of middle legs of said ferrite core along said reference direction.

9. The coil device as set forth in claim 1, wherein;

said first bobbin and second bobbin are assembled so that a first through hole of said first hollow cylinder is connected with a second through hole of said second hollow cylinder, and so that a top of said first hollow cylinder fits into a concave which is formed at the bottom of said second bobbin.

* * * * *